United States Patent [19]

Gipson

[11] Patent Number: 4,673,035

[45] Date of Patent: Jun. 16, 1987

[54] METHOD AND APPARATUS FOR INJECTION OF TUBING INTO WELLS

[76] Inventor: Thomas C. Gipson, 5431 Callaghan Rd., San Antonio, Tex. 78228

[21] Appl. No.: 816,288

[22] Filed: Jan. 6, 1986

[51] Int. Cl.[4] ..... E21B 19/22

[52] U.S. Cl. ..... 166/77; 166/77.5; 166/85

[58] Field of Search ..... 166/77, 78, 75.1, 84, 166/77.5, 85; 175/103, 162

[56] References Cited

U.S. PATENT DOCUMENTS

| | | | |
|---|---|---|---|
| 2,345,816 | 4/1944 | Hays | 255/1.6 |
| 3,116,781 | 1/1964 | Rugeley et al. | 153/54 |
| 3,116,793 | 1/1964 | McStravick | 166/77 |
| 3,291,256 | 12/1966 | Eitel | 182/129 |
| 3,559,905 | 2/1971 | Palynchuk et al. | 242/54 |
| 3,690,136 | 9/1972 | Slator et al. | 166/77 X |
| 3,722,775 | 3/1973 | Sarracino et al. | 226/100 |
| 3,762,725 | 10/1973 | Taylor | 166/84 X |
| 3,777,964 | 12/1973 | Kruner | 226/183 |
| 3,794,233 | 2/1974 | Dykmans | 226/183 |
| 3,872,680 | 3/1975 | Nicholson et al. | 61/72.3 |
| 3,902,612 | 9/1975 | Hall | 214/77 |
| 4,003,435 | 1/1977 | Cullen et al. | 166/77 X |
| 4,009,754 | 3/1977 | Cullen et al. | 166/77 |
| 4,066,093 | 1/1978 | Egerstrom | 137/355.2 |
| 4,103,841 | 8/1978 | Flynn et al. | 242/86.2 |
| 4,145,014 | 3/1979 | Chatard et al. | 242/83 |
| 4,553,590 | 11/1985 | Phillips | 166/77 X |

OTHER PUBLICATIONS

Otis Engineering Corp., advertisement, 46 Drilling: The Wellsite Publication 2-3 (Feb. 1985).

*Primary Examiner*—Stephen J. Novosad
*Assistant Examiner*—Thuy M. Bui
*Attorney, Agent, or Firm*—Cox & Smith Inc.

[57] ABSTRACT

Apparatus for injecting tubing into a well having a storage reel which traverses in a direction substantially perpendicular to the direction of movement of the tubing as the tubing is being pulled off of or wound back onto the tubing storage means. The unit may also be provided with a platform on which the tubing injector reel may be elevated to allow the operation of the apparatus with elevated well heads. Also provided is a method of retrieving a length of coil tubing and storing the coil tubing on a storage reel.

14 Claims, 8 Drawing Figures

METHOD AND APPARATUS FOR INJECTION OF TUBING INTO WELLS

BACKGROUND OF THE INVENTION

The present invention relates to a coil tubing injector. More particularly, the present invention relates to a coil tubing injector mounted on a truck with means for evenly reeling the tubing on a storage reel, means for straightening the tubing before injecting it into the well, and means for positioning the injector over the well bore to facilitate injection of the tubing.

Continuous tubing is often used to aid in completion, servicing or production of a well. Often, after the well has been drilled, or even during the drilling process, it is desired to pass a separate tube down the bore hole for passing gasses and fluids down into the hole for a particular purpose. For example, the tubing can be used for the circulation of nitrogen, oil, water, acid, alcohol, chemicals or solvents, for downhole workovers, location of hydrate plugs, placing of cement plugs through packers, and for circulating cement to casing bottoms, among other functions. The placement of the tube in the hole is accomplished by means of a device called an "injector", so-called because the tubing must be forced into the hole until enough of the tubing has been injected that the weight of the tubing inserted into the hole is sufficient to overcome the pressure in the borehole and the resistance to downward movement of the tubing imposed by the straightener.

Normally, the tubing used is a continuous length of tubing without couplings. The use of tubing without couplings decreases the likelihood of rupture of the tubing when injecting gases and fluids into the well hole at extremely high pressures. Also, injection of continuous tubing into the well bore at a steady rate is normally faster than assembling tubing joint by joint for lowering into the hole. Thus, continuous tubing can help save time and drilling costs.

In order to handle and store the continuous tubing, the tubing must be capable of being wound onto a reel or otherwise coiled. If the tubing material is made of PVC pipe or other high-strength plastic, coiling of the tubing for storage poses no significant problems, because the plastic tends to straighten itself when uncoiled for injection into a well bore. However, under certain downhole conditions, more durable materials are required for the tubing. For example, PVC pipe is able to withstand only relatively low pressures. Further, high-strength, low-alloy steel is often used in "sour" environments, i.e., environments in which large amounts of acid or sulfur gases are present. The use of continuous steel pipe which must be stored by coiling poses significant problems because, when uncoiled, the steel pipe tends to retain the curvature imparted to it during storage.

Known tubing injectors consist of a series of moving blocks driven by chains which grip the tubing on opposite sides, pulling it out of storage and and injecting it into the well and straightening it at the same time. However, this type of apparatus for injecting and straightening the tubing often damages the surface of the tubing. Thus, there is a need for a coil tubing injector which both injects and straightens the tubing, but which does not damage the surface of the tubing, thereby extending the life of tubing such as the copper tubing described below, which is relatively expensive to replace. Such a device would be of particular utility for use with special purpose tubing, for example, copper tubing with fiberglass coating such as is used in some segments of the industry for heating thick oil in the well to facilitate production. In these situations, the fiberglass coating is easily damaged by known injecting and straightening devices.

Another limitation of known tubing injectors is the expense of purchasing and maintaining them. By virtue of their size, even second-hand injectors are so expensive to purchase and operate that it is not economical to use them to service moderate or low production wells. In fact, because of this expense, many wells which need to be cemented, an operation which is best carried out by the use of a tubing injector, are not cemented, creating an environmental and safety hazard.

Another problem with known tubing injectors is the interaction between the injecting/straightening unit and the borehole. Because of the many different applications for which tubing may be utilized, the ideal device would be capable of being used on uncased, uncompleted borehole, a producing well which has a well head and "Christmas tree" in place above the borehole, or a well with any other equipment in place. To meet these different operating conditions, without having to alter the well site by removing the Christmas tree or adding well heads, it is desirable that the injecting/-straightening unit be capable of operating essentially independently of the well. In other words, to service a producing well, the injecting/straightening unit must be able to rise up over the Christmass tree, some of which are over eight feet high, and operate above it. On the other hand, for an unfinished well, the injecting/-straightening unit must operate almost at ground level.

Another consideration in having a tubing injector which operates independently of the equipment on the well is the recent advancement in other areas of oil and gas production in which the tubing injector is used to operate other downhole equipment or as a medium for performing various production tests and remedial operations. When used in this manner, it is desirable that this additional equipment be placed below the injecting and straightening means.

Another problem with known tubing injectors is that the flexibility of their operation is limited by the requirement that the injector be bolted to the well head for support and stability. If the tubing injector is to used on a well before the well head has been attached, or where attachment is inconvenient, a tubing injector which does not need to be attached to the well structure has significant advantages.

U.S. Pat. No. 3,116,781 is directed to a device which injects coil tubing. However, that device is limited in its ability to be adapted to operate over elevated well heads. Further, the utility of that device is limited by the use of the storage reel shown. As tubing is wound on the storage reel as it is retrieved from the well, it will not be distributed across the width of the reel, using its storage capacity to the fullest extent. In an attempt to provide an apparatus which distributes the tubing evenly in storage, injectors have been built with a guide, not unlike the level wind or traverse of a fishing reel, to distribute the tubing evenly onto the reel. However, this design imposes a design limitation on the injector unit which increases the cost and size of the injector unit. To traverse the tubing across the entire width of the reel, it is necessary that the apparatus guiding the tubing be placed at a substantial distance from the reel. Otherwise, when the guiding apparatus moves the tubing to one of the extreme edges of the reel, the tubing will be bent. If the guiding apparatus is positioned on the truck, a greatly increased length of the truck is required, and likewise, an increasingly expensive cost to avoid imparting a bend to the tubing. Further, the increased size creates problems such as the inability of such units to gain access to wells which are, for instance, between structures or other obstacles or in limited working areas.

An example of a design which provides one solution to this design limitation is the tubing injector marketed by Otis Engineering Corporation, which achieves the required distance by mounting the injector/straightener unit on a crane or boom at the rear of the truck or truck trailer on which the unit is mounted. However, the use of a crane creates additional problems such as clearance, increased maintenance and hydraulic system requirements and so forth.

Therefore, it is an object of the present invention to provide a tubing injector which is characterized by its ability to distribute the coil tubing onto a storage means without bending the tubing while still being small enough to be built and operated economically.

It is another object of the present invention to provide a tubing injector comprising a frame with a subframe slidably mounted thereon, a tubing storage means being mounted on the subframe and having coil tubing stored thereon, an injector reel mounted on the frame, means for rotating the injector reel, means mounted around a portion of the circumference of the injector reel for exerting pressure against the coil tubing when the coil tubing is directed between the circumference of the injector reel and said pressure exerting means, means for straightening the tubing, and means for slidably reciprocating the subframe across the frame as the tubing is being returned to the storage means.

It is another object of the present invention to provide a tubing injector unit which does not damage the exterior of the coil tubing.

A further object of the present invention is to provide a tubing injector unit which can operate at different heights above the well.

A further object of the present invention is to provide a tubing injector unit which can be operated without being attached to the well structure.

A further object of the present invention is to provide a tubing injector unit which stores the tubing evenly on a storage reel by traversing the reel as the tubing is withdrawn from the well.

These and other objects of the present invention will be evident to those skilled in the art from the following detailed description of the preferred embodiment.

SUMMARY OF THE INVENTION

These objects are accomplished in the present invention by providing a tubing injector comprising a frame and having a subframe slidably mounted on the frame. A tubing storage means having a length of coil tubing stored thereon is mounted to the subframe, and a rotating injector reel is also mounted on the frame. Means is mounted around a portion of the circumference of the injector reel for exerting pressure against the circumference of the injector reel to provide positive engagement of the tubing by the injector reel when the reel is rotated to pull the tubing off of or return the tubing to the tubing storage means. A tubing straightening means is provided to straighten the tubing after it is pulled off of the tubing storage means. The injector reel may be mounted on a platform which is pivotally mounted to the frame and may be positioned at various heights relative to the frame by a positioning means. Means is provided for reciprocating the tubing storage means while the tubing is being returned to the tubing storage means to distribute the tubing evenly on the tubing storage means.

DESCRIPTION OF THE PREFERRED EMBODIMENT

Figure 1:
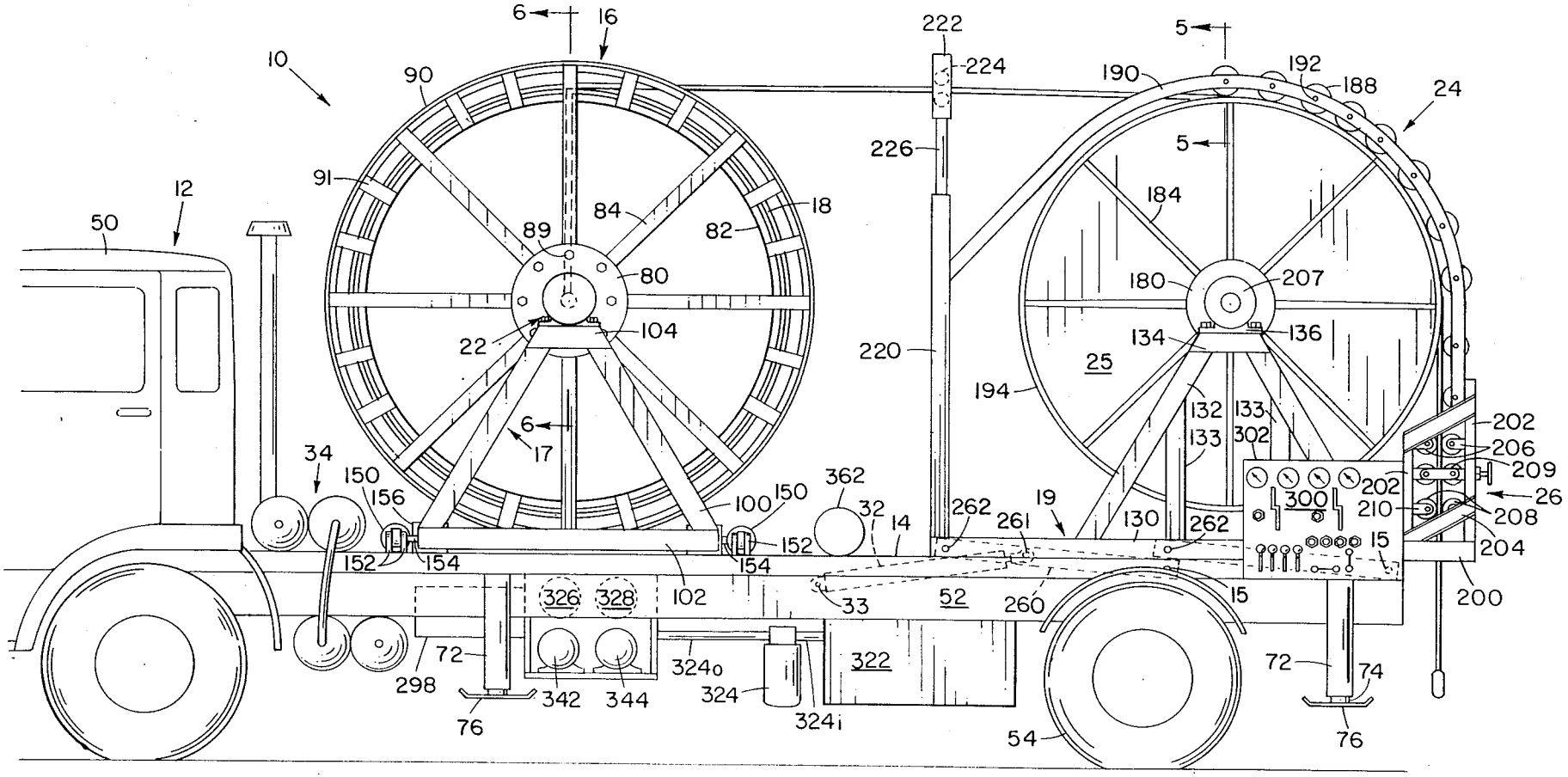
FIG. 1 is a side view of a tubing injector constructed according to the teachings of the present invention.

Referring to FIG. 1, there is shown a presently preferred embodiment of the present invention, indicated generally at reference numberal 10. In the embodiment shown in FIG. 1, the device 10 is mounted to a truck 12, but it is understood that the device 10 could be mounted to a trailer or on a frame (not shown) which could be slid or lifted onto or off of a truck or trailer. As shown in FIG. 1, the device 10 is mounted on the frame 14 of truck 12.

A tubing storage means, in the form of a storage reel 16, is mounted to the subframe 17, and coil tubing 18 is stored thereon. The subframe 17 is comprised of base beams 102 which extend in a direction parallel to the axis of the frame 14, and stringers 151, which extend perpendicularly in a transverse position across the frame 14. Reel support beams 100 are affixed to the corners of subframe 17 formed by the stringers 151 and the base beams 102. Horizontal beams 104 are welded to the tops of reel support beams 100 and ear 106 is bolted to the horizontal beam 104 on one side of storage reel 16. Ear 106 contains a bearing (not numbered) in which axle 86 of storage reel 16 is journalled. The horizontal beam 104 on the other side of storage reel 16 is provided with means operable to rotate storage reel 16 in the form of a hydraulic motor 22 in which axle 86 is journalled.

Figure 6:
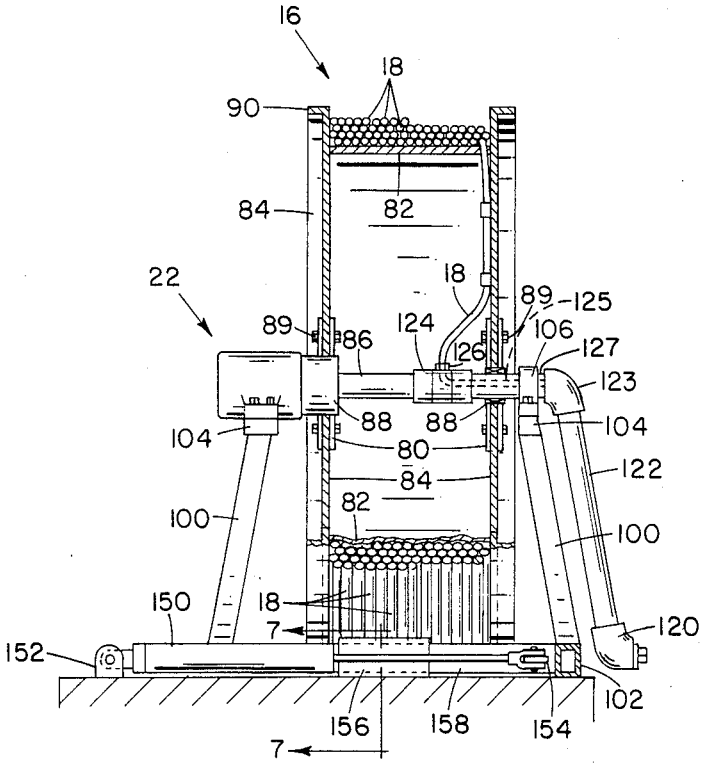
FIG. 6 is a cross sectional view of the reel of the tubing injector of FIG. 1 taken along the lines 6—6 in FIG. 1, a portion of the reel being broken away to show the details of the tranversing mechanism and the axle coupling.

Storage reel 16 is provided with a hub 80 which rides on bearings 88 (see FIG. 6) on axle 86. Spokes 84 are bolted to hub 80 by bolts 89 and extend radially from the hub 80 to support drum 82. Rim 90 is a continuous band around the circumference of storage reel 16, and members 91 are provided at spaced intervals to provide further support for drum 82 and rim 90.

Cement or other fluid travels up through the coupling 120, pipe 122 and elbow 123 into swivel joint 127. Axle 86 rotates with storage reel 16 and is provided with a passage 125 to allow the fluid to flow from swivel joint 127 to the collar connector 124. Collar connector 124 is provided with a coupler 126 into which the tubing 18 is connected to allow the fluid in axle 86 to flow up through the tubing 18 under pressure and down into the well.

Figure 3:
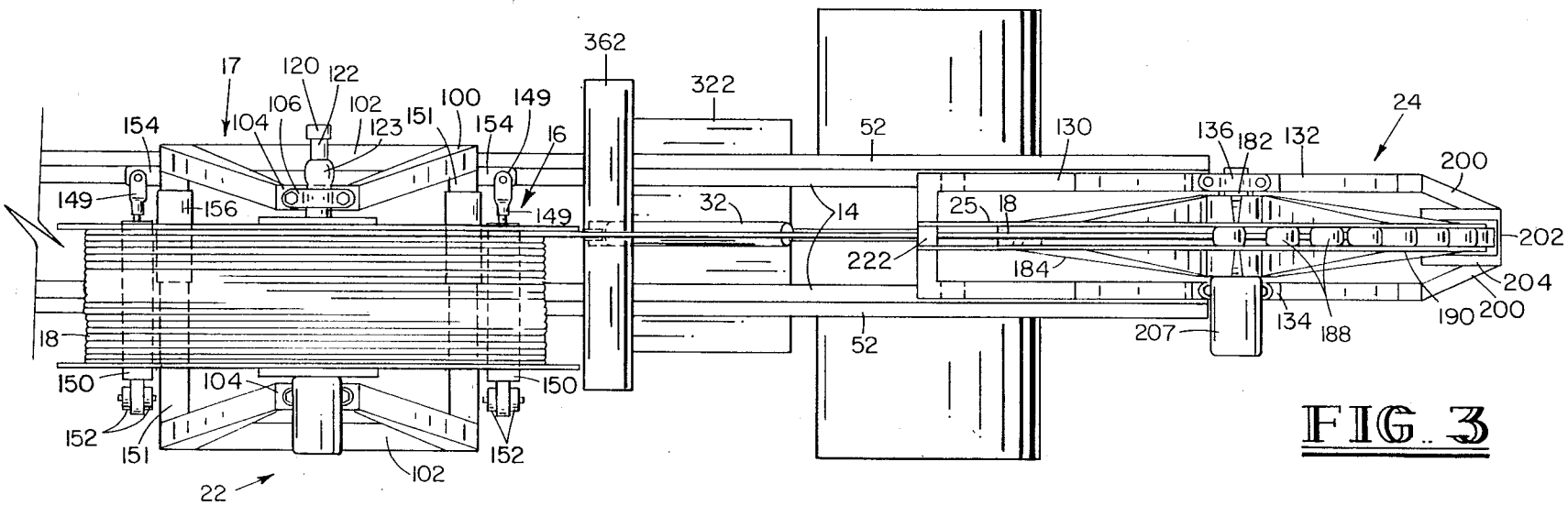
FIG. 3 is a top view of the tubing injector of FIG. 1 with the storage reel traversed to one extreme during the return of the tubing to the storage reel, i.e., while the tubing is being withdrawn from a well.
Figure 4:
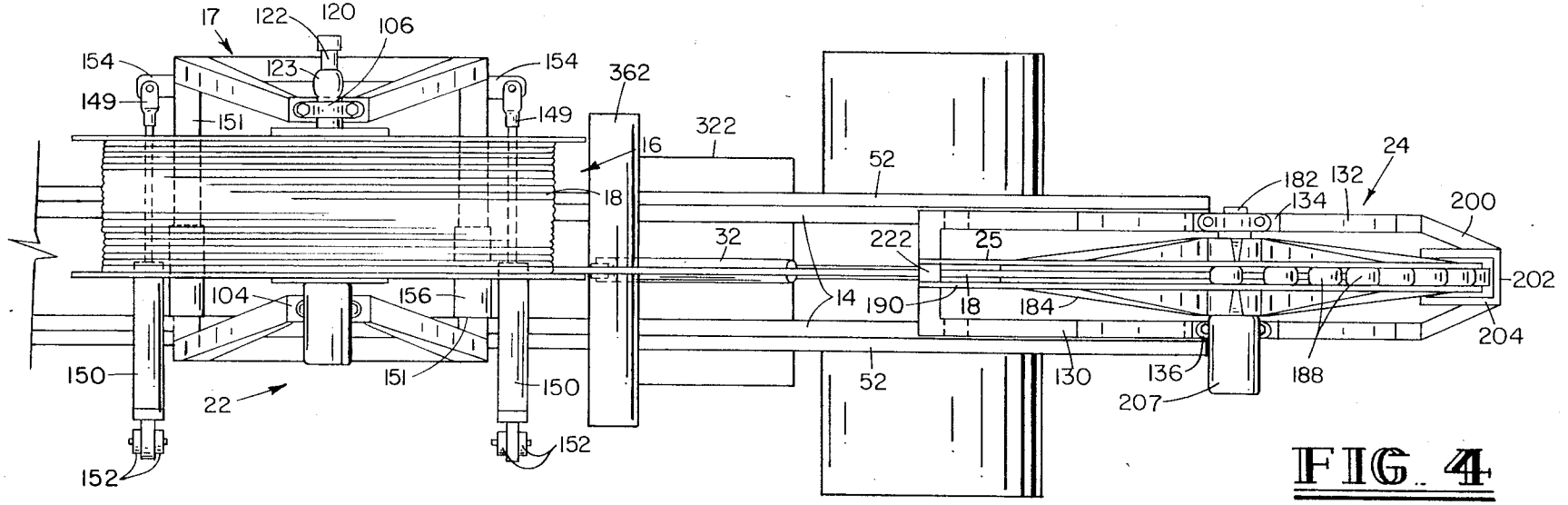
FIG. 4 is a top view similar to FIG. 3 of the tubing injector of FIG. 1 with the storage reel traversed to the other extreme.
Figure 7:
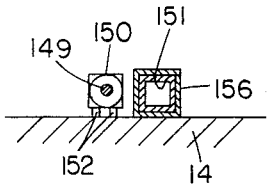
FIG. 7 is a cross sectional view of the traversing mechanism taken along the line 7—7 in FIG. 6.

Referring to FIGS. 3, 4 and 7, the stringers 151 are slidably received within the channel beams 156 which are integral with frame members 14. Ears 154 are welded to stringers 151 to form a point of attachment for the ram 149 of hydraulic cylinders 50. As can be seen in FIGS. 3 and 4, the hydraulic cylinders 150 are mounted to flanges 152 such that extension of the rams 149 of hydraulic cylinders 150 causes the subframe 17 to be shifted transversely across frame 14 in channel beam 156 a direction substantially perpendicular to the direction of movement of tubing 18 while tubing 18 is being wound onto or off of storage reel 16, while retraction of the rams 149 of hydraulic cylinders 150 causes the subframe 17 to traverse the frame 14 in the opposite direction, but still substantially perpendicular to the direction of movement of tubing 18. By alternating extension and retraction of the rams 149 of hydraulic cylinders 150 as will be explained, subframe 17 is slidingly reciprocated within channel beam 156 to distribute tubing 18 evenly on storage reel 16 while the tubing 18 is being returned to the storage reel 16. When the subframe 17 is in its intermediate position, the rams 149 of each of the hydraulic cylinders 150 are halfway extended.

Referring again to FIG. 1, the device 10 is provided with an injector, indicated generally at reference numberal 24. The injector 24 is comprised of an injector reel 25 mounted on axle 182. The axle 182 is journalled in ears 136, which are bolted to the horizontal beams 134. Horizontal beams 134 are supported by the support beams 132 and vertical beams 133. The support beams 132 and vertical beams 133 are integral with the longitudinal base members 130 of platform 19. Hydraulic motor 207 is mounted to the axle 182 of injector reel 25, and causes the injector reel 25 to rotate on axle 182. Injector reel 25 is provided with a hub 180 to which spokes 184 are welded to provide additional support and rigidity to injector reel 25. The circumference of injector reel 25 is provided with mirror-image flanges 194 which define a U-shaped groove 186. The U-shaped groove 186 is provided with a rubber insert 191 having a channel 193 in the exterior surface thereof for receipt of the tubing 18 (see FIG. 5).

Figure 5:
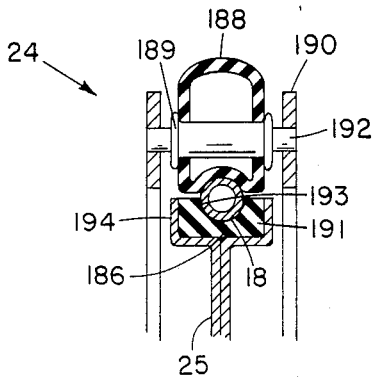
FIG. 5 is a partial cross sectional view of the tubing injector of FIG. 1 taken along the lines 5—5 in FIG. 1.

Also mounted to the platform 19 is vertical support bracket 220, which serves to support member 190, which extends upwardly and around in close approximation to a portion of the circumference of injector reel 25. A plurality of axles 192 are journalled in support member 190, each of the axles 192 bearing a pneumatic tire or roller 188 on a bearing 189 (see FIG. 5). Member 190, axles 192 and rollers 188 serve as a means to exert pressure against tubing 18 when tubing 18 is directed into the channel 193 in rubber insert 191 between the injector reel 25 and the rollers 188. As is shown in FIG. 5, the bottom surface of tubing 18 within the channel 193 of the rubber insert 191 is positively engaged with the rubber insert 191 by means of the compression applied against the top surface of tubing 18 by roller 188. In conjunction wih the rotational force imparted to the injector reel 25 by hydraulic motor 207, this positive engagement of the tubing 18 provides the force necessary to force the tubing 18 down into a well bore, overcoming the pressure in the well, the resistance to downward movement imposed by the straightener 26 and the inertial weight of the tubing on the storage reel 16 of the device 10.

Because there is no need to traverse the tubing storage means 16 during the injection of the tubing 18 into the well, the subframe 17 can remain stationary while tubing 18 is pulled off of tubing storage means 16 by positive engagement of the tubing 18 by injector reel 25. When operated in this manner, tubing 18 can be injected into the well and power can be saved because it is not necessary to traverse the subframe 17 back and forth across the truck frame 14. However, when the subframe 17 is not traversed back and forth across truck frame 14, the tubing 18 is pulled off of storage reel 16 from different, continually changing, angles such that the tubing 18 does not always come off of the tubing storage means 16 in alignment with the groove 186 of injector reel 25. For this reason, a guide 222 is provided having rollers 224 mounted therein to align tubing 18 with the groove 186. The guide 222 is mounted on member 226 which is telescopically received in vertical support bracket 220 and which floats therein. Vertical support bracket 220 is integral with platform 19 and does not reciprocate transversely with storage reel 16.

Figure 2:
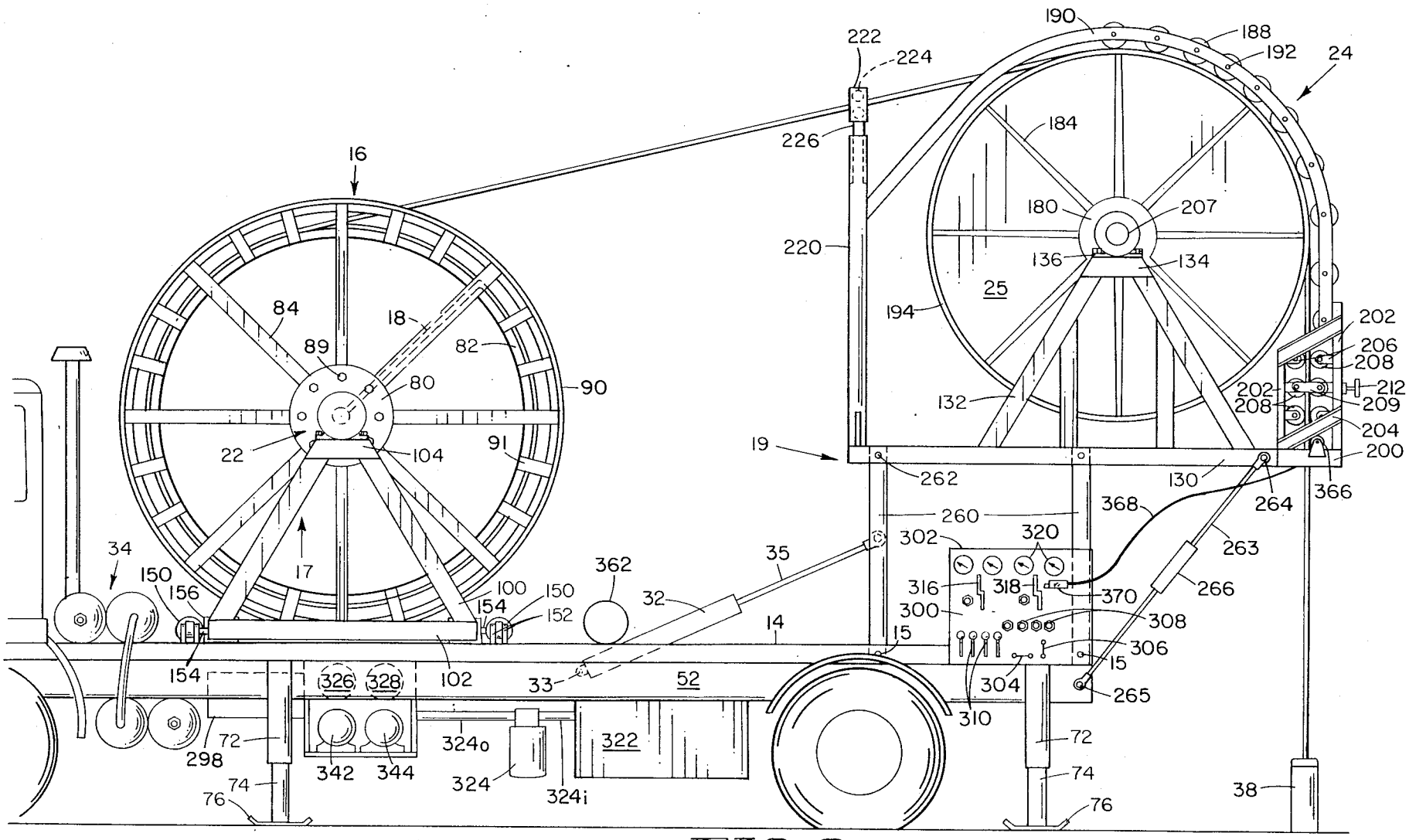
FIG. 2 is a side view of the tubing injector of FIG. 1 in operation.

Platform 30 is provided with a plurality of support members 260 pivotally mounted to frame 14 on pins 15 and to platform 19 by pins 262. In conjunction with hydraulic cylinder 32, which is pivotally mounted to the undercarriage 52 of truck 12 on pin 33 and to the support member 260 on pin 261, the support members 260 form a means operable to raise platform 19, having the injector reel 25 mounted thereon, up off of frame 14. As is shown in FIG. 2, support members 260 are mounted toward one end of the longitudinal frame members 130 so that, when the ram 35 of hydraulic cylinder 32 is extended, the platform 19, having injector reel 25 mounted thereon, is raised upwardly off of frame 14 while being simultaneously pivoted toward the rear of the frame 14 of truck 12. The platform 19 is shown in its raised position in FIG. 2 up over a well head 38 for operation. A brace 263 may be provided on both sides of platform 19 to further stabilize the platform 19 when raised. Brace 263 is mounted on pin 264 on longitudinal beam 130 at one end, on pin 265 on frame member 14 at the other end, and provided with threaded turnbuckle 266 to adjust its length. It will be understood by those skilled in the art who have the benefit of this disclosure that the device 10 can also be operated without pivoting the platform 19 to its raised position as shown in FIG. 2 when the device 10 is used in connection with a well head which is not elevated.

As is clear from the above description of the operation of the device 10 of the present invention, the frame 14 of truck 12 must be stabilized during the operations. Stabilization is accomplished by means of the leveling cylinders 72 mounted to the chassis 52 of truck 12. The rams 74 of leveling cylinders 72 are provided with stabilizing pads 76 to insure proper footing on the surface upon which the device 10 is operating as shown in FIG. 2.

Platform 19 is also provided with a means for straightening the tubing 18 as it comes off of the reel 25 on its way down into the well 38. This tubing straightening means 26 is mounted on a frame 200 attached to the back of the longitudinal support beam 130 of platform 19. Frame 200 is provided with vertical support brackets 202 and cross beams 204. The vertical support brackets 202 serve as a mount for the ears 206 upon which the opposed rollers 208 are mounted. As shown in FIG. 2, the top and bottom sets of opposed rollers 208 are in closely spaced, fixed relationship and the middle set of rollers 209 is provided with an adjustment means in the form of screw 212 by which the alignment of the middle rollers 209 can be changed to increase or decrease the amount of force which is applied to the tubing 18 between the top and bottom rollers 208 to straighten the tubing.

Control of the device 10 is provided by a control panel 300 mounted on control box 302. Control box 302 is mounted to the frame 14 and chassis 52 of truck 12. Control box 302 may be provided with a hinged cover (not shown) to cover the control panel 300. Control panel 300 is provided with a valve lever 304 for raising and lowering of the platform 19 and a valve lever 306 for control of the hydraulic cylinders 150. Torque control valves 308 are also provided on the control panel 300, an up and down valve being provided for each of the two reels. Controls 310 are also provided for the leveling cylinders 72. An on-off switch 312 is provided for the brake 340 as will be described. An emergency kill switch 314 is provided to stop the engine of the truck 12. Also provided on the control panel 300 is a storage reel control transmission 316 having an up, down and neutral position, and an injector reel control transmission 318 having up, down and neutral positions. A row of four pressure gauges is provided, one gauge each for the raising and lowering of the tubing 18 for the storage reel 16 and the injector reel 25.

Figure 8:
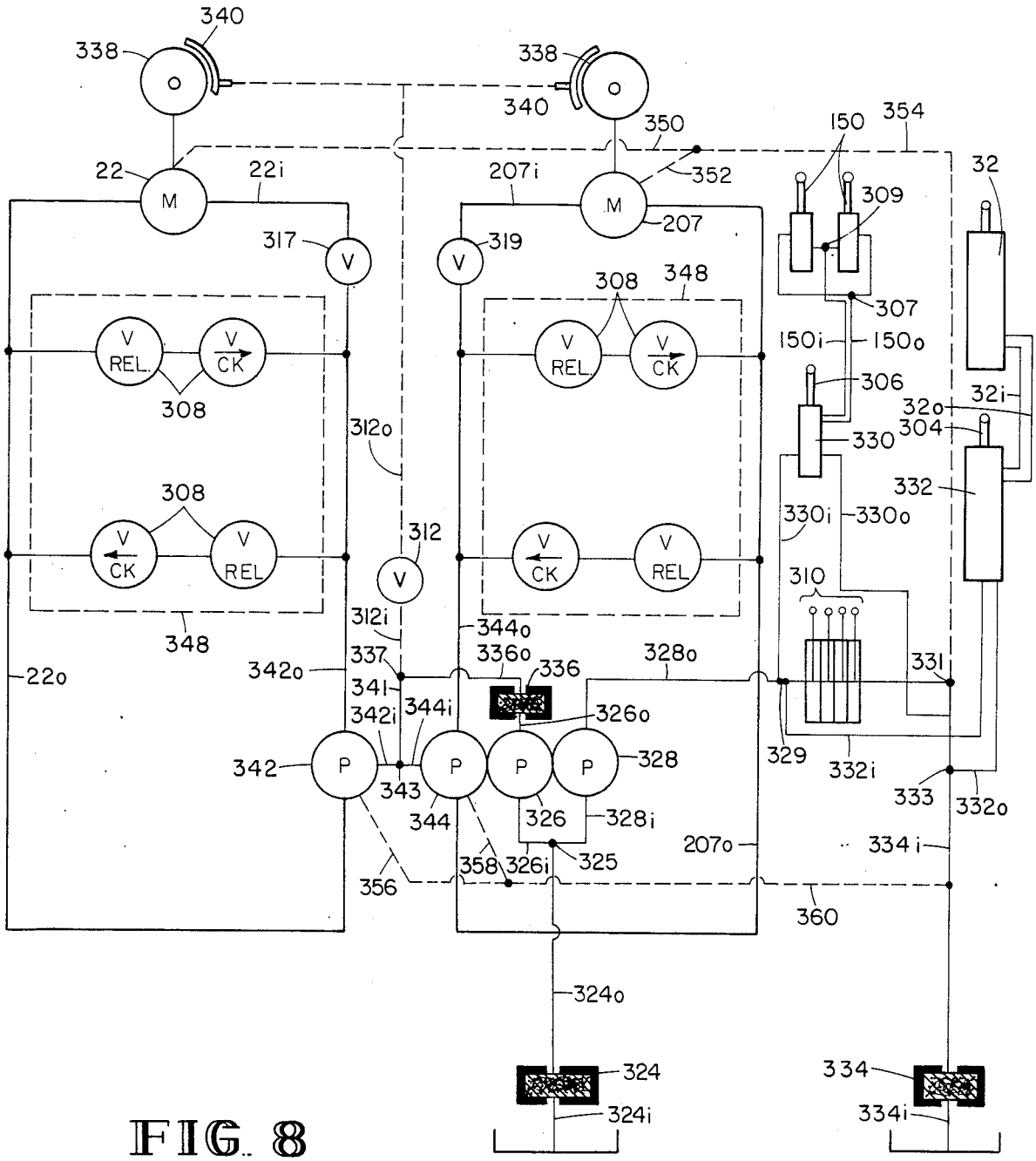
FIG. 8 is a schematic diagram of the hydraulic system of the apparatus of FIG. 1.

The hydraulic control system is shown in FIGS. 1, 2 and 8. Hydraulic fluid is contained within the reservoir 322 and flows out of the reservoir 322 through line $\mathbf{324}_i$ into filter 324, and on through line $\mathbf{324}_o$ into a T-intersect 325 which splits the hydraulic fluid, a portion of the hdyraulic fluid going through the line $\mathbf{326}_i$ to the feed pump 326, and a portion of the hydraulic fluid going through the line $\mathbf{328}_i$ to the auxiliary pump 328. As shown in FIG. 8, the hydraulic fluid which is pumped by the auxiliary pump 328 is pumped through line $\mathbf{328}_o$ to a pair of T-intersects, indicated generally at 329 and on through line $\mathbf{330}_i$ and line $\mathbf{332}_i$ to the four-way valves 330 and 332, respectively. Four-way valve 330 is active in one position to pass hydraulic fluid into the line $\mathbf{150}_i$ to activate the hydraulic cylinders 150, in another position to pass hydraulic fluid into line $\mathbf{150}_o$, and in another position to bypass hydraulic fluid into the return line $\mathbf{330}_o$. The hydraulic fluid which flows through the four-way valve 330 to the hydraulic cylinders 150 through line $\mathbf{150}_i$, and the T-intersect 307 is returned through T-intersect 309 and line $\mathbf{150}_o$ through the four-way valve 330 and into the return line $\mathbf{330}_o$.

Similarly, the control 304 of four-way valve 332 is operative in one position to pass hydraulic fluid into the line $\mathbf{32}_i$ to activate hydraulic cylinder 32, in a second position to pass hydraulic fluid into line $\mathbf{32}_o$, and in another position to bypass hydraulic cylinder 32, routing the hydraulic fluid directly into the return line $\mathbf{332}_o$. When fluid is routed into the line $\mathbf{32}_i$ to activate hydraulic cylinder 32, the hydraulic fluid is returned to the four-way valve 332 through return line $\mathbf{32}_o$, and on through the valve 332 to the return line $\mathbf{332}_o$. Both the return lines $\mathbf{330}_o$ and $\mathbf{332}_o$ route the hydraulic fluid through T-intersects 331 and 333, respectively, into line $\mathbf{334}_i$, and on into the filter 334, through the filter and on through return line $\mathbf{334}_o$ to the reservoir 322.

The hydraulic fluid is routed to the feed pump 326 through line $\mathbf{326}_i$ and on through line $\mathbf{326}_o$ to the filter 336. The fluid is pumped through line $\mathbf{336}_o$ to the T-intersect 337 where the hydraulic fluid is split between line $\mathbf{312}_i$, which directs fluid to the brake on-off switch 312, and line 341. Line 341 directs hydraulic fluid to the T-intersect 343, which provides hydraulic fluid to the storage reel pump 342 and injector reel pump 344, through lines $\mathbf{342}_i$, and $\mathbf{344}_i$, respectively. The hydraulic fluid which passes through line $\mathbf{312}_i$ and into the brake on-off switch 312 provides power to the brakes 340 through line $\mathbf{312}_o$. Feed pump 326 operates continuously to keep approximately 200 pounds of pressure on the hydraulic fluid in the line $\mathbf{312}_o$, the brakes 340 being powered off such that when the on-off switch 312 is in the off position, the brakes 340 engage the brake drums 338 of the hydraulic motors 22 and 207.

The fluid which is provided to the pump 342 through line $\mathbf{342}_i$ is pumped out of the pump 342 through line $\mathbf{342}_o$ to valve 317, and on through line $\mathbf{22}_i$ to the hydraulic motor 22 mounted on the storage reel 16. Fluid passes through the hydraulic motor 22 and is returned to pump 342 through return line $\mathbf{22}_o$. The hydraulic fluid provided to the pump 344 through line $\mathbf{344}_i$ is pumped through the pump 344 into the line $\mathbf{344}_o$ to valve 319, and on through line $\mathbf{207}_i$ to the hydraulic motor 207 on the injector reel 25. Hydraulic fluid is returned from hydraulic motor 207 through the return line $\mathbf{207}_o$ to pump 344. Pumps 342 and 344 are variable displacement pumps controlled from panel 300 by transmission controls 316 and 318, respectively, which open and close valves 317 and 319, respectively, by means of a bicycle hand brake-type cable (not shown). Reduction gears (not shown) are provided to transmit the rotational movement of the hydraulic motors 22 and 207 into rotational movement of the storage reel 16 and injector reel 25, respectively.

As indicated above, the feed pump 326 operates continuously so that circulation is maintained throughout the hydraulic system at all times. Consequently, appropriate return lines 350, 352, 354, 356, 358 and 360 are provided, all of which are connected by appropriate T-intersects into the line $\mathbf{334}_i$, thereby returning this continually circulating hydraulic fluid to reservoir 322.

The operation of the device 10 is evident from its construction. Briefly, the truck 12 is positioned in close approximation to the well head 38 and the leveling cylinder controls 310 are used to provide stable footing on the surface upon which truck 12 rests by means of the stabilizing pads 76 and leveling cylinders 72. If necessary, hydraulic cylinder 32 is activated by means of the valve lever 304 to raise the platform 19 up over an elevated well head. Hydraulic motors 22 and 207 are then activated through control of the storage reel control transmission 316 and injector reel control transmission 318, respectively, to pull tubing 18 off of the storage reel 16, through the guide 222, between the rollers 188 and the rubber insert 191 on the U-shaped groove 186 of the injector reel 25, down through the straightener 26, and into the well head 38 (see FIG. 2). When a sufficient length of tubing 18 has been pulled off of the storage means 16 and injected into the well 38, the hydraulic motors 22 and 207 are stopped and the cement or other fluid pumped down the well through the coupling 120, pipe 122, elbow 123, axle 86, collar connector 124, and tubing 18.

To retract tubing 18 from the well, the direction of flow in hydraulic lines $22_i$ and $22_o$, and lines $207_i$ and $207_o$, is reversed by shifting the storage reel control transmission 316 and injector reel control transmission 318 to cause storage reel 17 and injector reel 25 to rotate in the opposite direction. As tubing 18 is retracted from the well, storage reel 17 is traversed first in one direction substantially perpendicular to the direction of movement of tubing 18 and then in the opposite direction by manual movement of the control 306 of four way valve 330, which alternately directs hydraulic fluid into line $150_i$ and $150_o$.

Referring again to FIG. 2, a spring-loaded roller 366 is mounted on frame 200, the spring (not shown) biasing roller 366 against tubing 18 as tubing 18 passes through straightener 26. An odometer-type cable 368 is provided to connect roller 366 to the digital read-out 370 on control panel 300. Roller 366, cable 368 and read-out 370 are not shown in FIG. 1 for purposes of clarity. The size of roller 366 is selected so that roller 366 rotates once for each one foot of tubing which passes it, consequently digital read-out 370 operates as a depth counter.

A nitrogen bottle 362 is mounted between the storage reel 16 and ejector reel 25. The nitrogen bottle contains nitrogen under high pressure, and in the event of a failure of the cement pump, the valve 364 is opened to allow the passage of high pressure nitrogen into the tubing 18 to blow the cement or other fluid out of the tubing 18. The nitrogen in the nitrogen bottle 362 can also be used to clear the lines after all the necessary fluid is pumped to prevent freezing in cold weather.

During the operation of the device 10, it is possible that the hydraulic motors 22 and 207, which power the storage reel 16 and injector reel 25, respectively, will encounter operating conditions in which the weight which the motors are able to pull back up out of the well or the force necessary to inject the tubing into the well is greater than the capacity of the motors 22 and 207. To prevent damage to the motors 22 and 207 under such circumstances, a series of four torque control valves 308 is provided, one torque control valve 308 for each reel in the up and down operating mode. These torque control valves 308 allow the hydraulic fluid in lines $22_i$ and $207_i$ to be bypassed around the hydraulic motors 22 and 207, respectively, into the lines $22_o$ and $207_o$, respectively. Some hydraulic motors available commercially are provided with their own pressure relief valves such that the valves 308 may be unnecessary depending upon the construction of those hydraulic motors. The valves and hydraulic lines enclosed within the boxes 348 on FIG. 8 may be omitted when such a hydraulic motor is used.

As is clear from the above description, the positive engagement of the tubing 18 by the rubber insert 191 contained within the flanges 194 of the injector reel 25 is crucial to the ability of the device 10 to inject the tubing into the well and to return the tubing from the well to the tubing storage reel 16. To insure this positive engagement of the tubing 18, the rubber insert 191 is provided with a channel 193 to contain the tubing 18 and to increase the friction between the rubber insert 191 and the tubing 18 by increasing the surface contact between them. Channel 193 is milled into the surface of rubber insert 191, causing the rubber insert 191 to be roughened within the circumference of the channel 193, helping to prevent slippage of the tubing 18 as injector reel 25 rotates. The rollers 188 are pneumatic tires to likewise increase the surface contact between the roller 188 and the tubing 18. The amount of pressure applied to the top surface of the tubing 18 as it is carried around the circumference of the injector reel 25 by the rubber insert 191 can be changed by increasing or decreasing the air pressure of the pneumatic tires which make up the rollers 188.

Although the present invention has been characterized in terms of the above-described presently preferred embodiment, it will be recognized by those skilled in the art who have the benefit of this disclosure that certain changes and variations may be made to that embodiment without departing from the spirit of the present invention. The present invention is not limited to the above-described presently preferred embodiment, and it is expected that such variations will be encompassed within the scope of the following claims.

What is claimed is:

1. A tubing injector comprising:

a frame;

a subframe slidably mounted on said frame;

tubing storage means mounted on said subframe and having coil tubing stored thereon;

an injector reel rotatably mounted on said frame;

means for rotating said injector reel;

means mounted around a portion of the circumference of said injector reel for exerting pressure against the coiled tubing when the coil tubing is directed between said pressure exerting means and the circumference of said injector reel to provide positive engagement of said tubing by said injector reel when said injector reel is being rotated to pull said tubing off of said tubing storage means or return said tubing to said tubing storage means;

means for straightening said tubing; and means for slidably reciprocating said subframe across said frame during the return of said tubing to said tubing storage means to distribute said tubing evenly on said tubing storage means.

2. The tubing injector of claim 1 wherein said pressure exerting means comprises means mounted concentrically around a portion of said injector reel having a plurality of rollers mounted thereon, said rollers being held by said concentrically mounted means in close approximation to the circumference of said injector reel.

3. The tubing injector of claim 1 wherein said injector reel is provided with means for preventing slipping of said tubing around the circumference of said injector reel during the return of said tubing to said tubing storage means and while said tubing is being pulled off of said tubing storage means.

4. The tubing injector of claim 3 wherein said slipping prevention means comprises a rubber insert mounted on the circumference of said injector reel.

5. The tubing injector of claim 1 wherein said subframe reciprocating means comprises a channel beam mounted transversely on said frame for slidably receiving said subframe and means mounted on said frame for reciprocating said subframe in a first direction relative to said subframe and then in the opposite direction relative to said subframe.

6. The tubing injector of claim 1 wherein said reel is mounted on a platform, said platform being pivotally mounted to said frame and provided with means for raising and lowering said platform up off of and back down onto said frame.

7. The tubing injector of claim 1 additionally comprising means for directing the coil tubing between the circumference of said injector reel and said pressure exerting means while the coil tubing is being pulled off said tubing storage means.

8. A tubing injector comprising:

a frame;

tubing storage means mounted on said frame and having coil tubing stored thereon;

a platform pivotally mounted on said frame;

an injector reel rotatably mounted on said platform;

means for rotating said injector reel;

means mounted around a portion of the circumference of said injector reel for providing positive engagement of said tubing by said injector reel when said reel is being rotated to pull said tubing off of said tubing storage means or return said tubing to said tubing storage means;

means for straightening said tubing; and means for raising said platform up off of said frame.

9. The tubing injector of claim 8 wherein said injector reel is provided with means for preventing slipping of said tubing around the circumference of said injector reel during the return of said tubing to said tubing storage means and while said tubing is being pulled off of said tubing storage means.

10. The tubing injector of claim 9 wherein said slipping prevention means comprises a rubber insert mounted on the circumference of said injector reel.

11. The tubing injector of claim 10 additionally comprising means for directing said tubing onto the rubber insert between said slipping prevention means and the circumference of said injector reel.

12. The tubing injector of claim 8 wherein said tubing storage means is mounted to a subframe provided with means for reciprocating said subframe during the return of said tubing to said tubing storage means to distribute said tubing evenly on said tubing storage means.

13. The tubing injector of claim 12 wherein said subframe reciprocating means comprises a channel beam mounted transversely on said frame for slidably receiving said subframe and means mounted on said frame for sliding said subframe in a first transverse direction on said channel beam, and then in the opposite transverse direction on said channel beam.

14. A method of retrieving a length of coil tubing and storing the tubing on a tubing storage means comprising:

rotating a reel;

exerting pressure against the circumference of said reel while running said tubing around a portion of the circumference to exert pressure against said tubing to cause positive engagement of said tubing by said reel;

routing said tubing off of said reel onto a tubing storage means; and reciprocating said tubing storage means in a plane substantially perpendicular to the direction of movement of said tubing to distribute said tubing evenly on said tubing storage means.

* * * * *

UNITED STATES PATENT AND TRADEMARK OFFICE

CERTIFICATE OF CORRECTION

PATENT NO. : B1 4,673,035
DATED : August 10, 1999
INVENTOR(S) : Thomas C. Gipson It is certified that error appears in the above-indentified patent and that said Letters Patent is hereby corrected as shown below:

On the cover page at line [73] Assignee:

delete

American Bank of Texas, Sherman, Texas and insert

Plains Energy Services, Ltd.
Calgary, Alberta, Canada

Signed and Sealed this

Eleventh Day of January, 2000

*Attest:*

*Attesting Officer*

Q. TODD DICKINSON

*Acting Commissioner of Patents and Trademarks*

US004673035B1

REEXAMINATION CERTIFICATE (3828th)

United States Patent [19] [11] B1 4,673,035

Gipson [45] Certificate Issued Aug. 10, 1999

[54] METHOD AND APPARATUS FOR INJECTION OF TUBING INTO WELLS

[75] Inventor: Thomas C. Gipson, San Antonio, Tex.

[73] Assignee: American Bank of Texas, Sherman, Tex.

Reexamination Request:
No. 90/004,892, Jan. 14, 1998

Reexamination Certificate for:

| | |
|---|---|
| Patent No.: | **4,673,035** |
| Issued: | **Jun. 16, 1987** |
| Appl. No.: | **06/816,288** |
| Filed: | **Jan. 6, 1986** |

[51] Int. Cl.[6] ..... E21B 19/22
[52] U.S. Cl. ..... 166/77.1; 166/77.5; 166/85.1
[58] Field of Search ..... 166/77.1, 78, 76.1, 166/89, 77.5, 86.1; 175/103, 162

[56] References Cited

U.S. PATENT DOCUMENTS

| | | | |
|---|---|---|---|
| 3,116,793 | 1/1964 | McStravick | 166/77 |
| 4,553,590 | 11/1985 | Phillips | 166/77 |

FOREIGN PATENT DOCUMENTS 953272 8/1974 Canada .

*Primary Examiner*—William P. Neuder

[57] ABSTRACT

Apparatus for injecting tubing into a well having a storage reel which traverses in a direction substantially perpendicular to the direction of movement of the tubing as the tubing is being pulled off of or wound back onto the tubing storage means. The unit may also be provided with a platform on which the tubing injector reel may be elevated to allow the operation of the apparatus with elevated well heads. Also provided is a method of retrieving a length of coil tubing and storing the coil tubing on a storage reel.

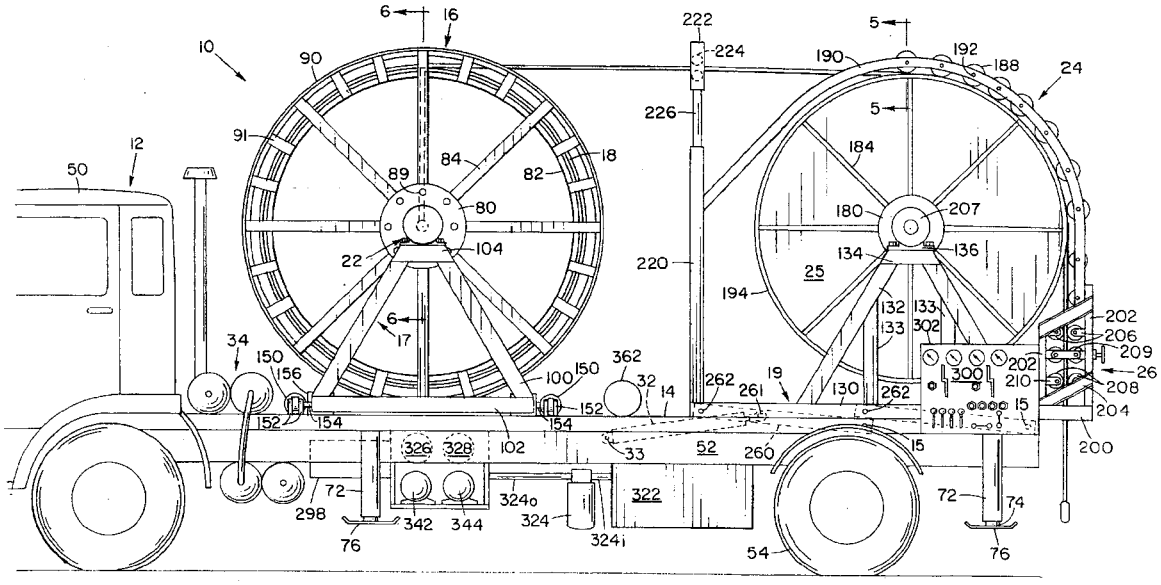

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–13 is confirmed.

Claims 1 and 14 are determined to be patentable as amended.

Claims 2–7, dependent on an amended claim, are determined to be patentble.

New claims 15–18 are added and determined to be patentable.

1. A tubing injector comprising:

a frame;

a subframe slidably mounted on said frame;

tubing storage means mounted on said subframe and having coil tubing stored thereon;

an injector reel rotatably mounted on said frame;

*means for raising said injector from a first position to a second position on said frame;* means for rotating said injector reel;

means mounted around a portion of the circumference of said injector reel for exerting pressure against the coiled tubing when the coil tubing is directed between said pressure exerting means and the circumference of said injector reel to provide positive engagement of said tubing by said injector reel when said injector reel is being rotated to pull said tubing off of said tubing storage means or return said tubing to said tubing storage means;

means for straightening said tubing; and means for slidably reciprocating said subframe across said frame during the return of said tubing to said tubing storage means to distribute said tubing evenly on said tubing storage means.

14. A method of retrieving a length of coil tubing and storing the tubing on a tubing storage means comprising:

*raising a reel above a frame;* rotating [a] *said* reel;

exerting pressure against the circumference of said reel while running said tubing around a portion of the circumference to exert pressure against said tubing to cause positive engagement of said tubing by said reel;

routing said tubing off of said reel onto a tubing storage means *on said frame*; and reciprocating said tubing storage means in a plane substantially perpendicular to the direction of movement of said tubing to distribute said tubing evenly on said tubing storage means.

*15. A tubing injector comprising:*

*a frame;*

*a subframe slidably mounted on said frame;*

*tubing storage means mounted on said subframe and having coil tubing stored thereon;*

*an injector reel rotatably mounted on said frame;*

*means for rotating said injector reel;*

*means mounted around a portion of the circumference of said injector reel for exerting pressure against the coiled tubing when the coil tubing is directed between said pressure exerting means and the circumference of said injector reel to provide positive engagement of said tubing by said injector reel when said injector reel is being rotated to pull said tubing off of said tubing storage means or return said tubing to said tubing storage means;*

*means for straightening said tubing;*

*means for slidably reciprocating said subframe across said frame during the return of said tubing to said tubing storage means to distribute said tubing evenly on said tubing storage means;*

*said injector reel is provided with means for preventing slipping of said tubing around the circumference of said injector reel during the return of said tubing to said tubing storage means and while said tubing is being pulled off of said tubing storage means; and*

*said slipping prevention means comprises a rubber insert mounted on the circumference of said injector reel.*

*16. A tubing injector comprising:*

*a frame;*

*a subframe slidably mounted on said frame;*

*tubing storage means mounted on said subframe and having coil tubing stored thereon;*

*an injector reel rotatably mounted on said frame;*

*means for rotating said injector reel;*

*means mounted around a portion of the circumference of said injector reel for exerting pressure against the coiled tubing when the coil tubing is directed between said pressure exerting means and the circumference of said injector reel to provide positive engagement of said tubing by said injector reel when said injector reel is being rotated to pull said tubing off of said tubing storage means or return said tubing to said tubing storage means;*

*means for straightening said tubing;*

*means for slidably reciprocating said subframe across said frame during the return of said tubing to said tubing storage means to distribute said tubing evenly on said tubing storage means; and*

*said subframe reciprocating means comprises a channel beam mounted transversely on said frame for slidably receiving said subframe and means mounted on said frame for reciprocating said subframe in a first direction relative to said subframe and then in the opposite direction relative to said subframe.*

*17. A tubing injector comprising:*

*a frame;*

*subframe slidably mounted on said frame;*

*tubing storage means mounted on said subframe and having coil tubing stored thereon;*

*an injector reel rotatably mounted on said frame;*

*means for rotating said injector reel;*

*means mounted around a portion of the circumference of said injector reel for exerting pressure against the coiled tubing when the coil tubing is directed between*

*said pressure exerting means and the circumference of said injector reel to provide positive engagement of said tubing by said injector reel when said injector reel is being rotated to pull said tubing off of said tubing storage means or return said tubing to said tubing storage means;*

*means for straightening said tubing;*

*means for slidably reciprocating said subframe across said frame during the return of said tubing to said tubing storage means to distribute said tubing evenly on said tubing storage means; and*

*said reel is mounted on a platform said platform being pivotally mounted to said frame and provided with means for raising and lowering said platform up off of and back down onto said frame.*

*18. A tubing injector comprising:*

*a frame;*

*a subframe slidably mounted on said frame;*

*tubing storage means mounted on said subframe and having coil tubing stored thereon;*

*an injector reel rotatably mounted on said frame;*

*means for rotating said injector reel;*

*means mounted around a portion of the circumference of said injector reel for exerting pressure against the coiled tubing when the coil tubing is directed between said pressure exerting means and the circumference of said injector reel to provide positive engagement of said tubing by said injector reel when said injector reel is being rotated to pull said tubing off of said tubing storage means or return said tubing to said tubing storage means;*

*means for straightening said tubing;*

*means for slidably reciprocating said subframe across said frame during the return of said tubing to said tubing storage means to distribute said tubing evenly on said tubing storage means; and*

*means for directing the coil tubing between the circumference of said injector reel and said pressure exerting means while the coil tubing is being pulled off said tubing storage means.*

* * * * *